US006853358B2

(12) United States Patent
Kunii et al.

(10) Patent No.: US 6,853,358 B2
(45) Date of Patent: Feb. 8, 2005

(54) METHOD AND DEVICE FOR DRIVING A PLASMA DISPLAY PANEL

(75) Inventors: Yasuhiko Kunii, Kawasaki (JP); Takashi Sasaki, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/686,573

(22) Filed: Oct. 17, 2003

(65) Prior Publication Data

US 2004/0085305 A1 May 6, 2004

(30) Foreign Application Priority Data

Oct. 30, 2002 (JP) ..... 2002-316156

(51) Int. Cl.[7] ..... G09G 3/28

(52) U.S. Cl. ..... 345/62; 345/3.1; 345/41; 345/60; 250/339.15; 250/553; 250/554

(58) Field of Search ..... 345/3.1, 30–62; 250/339.15, 553–554

(56) References Cited

FOREIGN PATENT DOCUMENTS

| | | |
|---|---|---|
| JP | 06-004039 | 1/1994 |
| JP | 2000-206928 | 7/2000 |
| JP | 2001-034227 | 2/2001 |

*Primary Examiner*—George Fourson
*Assistant Examiner*—Thanh V Pham
(74) *Attorney, Agent, or Firm*—Staas & Halsey LLP

(57) ABSTRACT

A method for driving a plasma display panel is provided in which wasteful power consumption is reduced and ion bombardment that may deteriorate cells is suppressed for a long life of cells. A ratio of lighting that is a ratio of the number of cells to be lighted to a total number of cells is detected in accordance with display data that determine contents of addressing. In accordance with the detected ratio of lighting, a waveform of a voltage pulse that is applied in the sustaining step for displaying the corresponding display data is changed so that a gradient of the voltage change at a leading edge becomes smaller for a large value of the ratio of lighting than for a small value of the same.

4 Claims, 11 Drawing Sheets

(A) WAVEFORM WHEN LIGHTING RATIO IS 0-40%

(B) WAVEFORM WHEN LIGHTING RATIO IS 41-60%

(C) WAVEFORM WHEN LIGHTING RATIO IS 61-100%

METHOD AND DEVICE FOR DRIVING A PLASMA DISPLAY PANEL

BACKGROUND OF THE INVENTION

1. Field of the Invention

The present invention relates to a method for driving a plasma display panel (PDP).

Television sets having a large screen of a PDP is becoming commonplace. As a resolution of a screen increases, a load of a power source circuit for a PDP in a display device becomes large. Therefore, countermeasures against the increasing load are requested.

2. Description of the Prior Art

An AC type PDP having three different fluorescent materials of different light emission colors is used for a color display. In the AC type PDP, display electrodes for generating display discharge that determines light emission quantity of cells are covered with a dielectric layer, and wall voltage that is generated by electrification of the dielectric layer is utilized for the display discharge. Among all cells within the screen, cells that are to generate display discharge are set to have higher wall voltage than other cells' wall voltage (usually zero volt). After that, a sustaining pulse train having amplitude lower than discharge start voltage is applied to every cell similarly. When a sum of the amplitude of the sustaining pulse and the wall voltage exceeds the discharge start voltage, display discharge is generated. At this time, ultraviolet rays are generated by a discharge gas and excite fluorescent materials in cells so as to emit light. The sustaining pulse is applied for approximately a few microseconds, and the light emission looks continuous.

The application of the sustaining pulse train by the driving device is performed for all cells at the same time after a line-sequential addressing step in which wall voltage in each cell of the screen corresponds to display data. A waveform of a usual sustaining pulse has a simple rectangular shape. Responding to the application of the sustaining pulse, display discharge is generated in all cells to be lighted substantially at the same time. Accordingly, concentrated discharge current flows temporarily from the power source circuit of the driving device to the plasma display panel. This concentration of the discharge current may cause a drop in amplitude of the sustaining pulse, i.e., a voltage drop, thereby the display distortion is generated. A power source circuit that can supply a current large enough to avoid the voltage drop is expensive, and it is not realistic to use such a power source circuit in the driving device.

A driving method that can relieve the concentration of the discharge current is disclosed in Japanese unexamined patent publication No. 2001-34227. In the method the waveform of the sustaining pulse is made a trapezoidal shape having a gentle voltage change at a leading edge. Since there is a little variation in the discharge start voltage among cells, some cells are relatively easy to start discharge but other cells are hard. Responding to the application of the sustaining pulse, display discharge begins at cells having low discharge start voltage at first. After that, display discharge begins at cells having high discharge start voltage. If the voltage change at leading edges of the sustaining pulse is gentle, a time point when display discharge begins in cells having high discharge start voltage is delayed compared with the case where the voltage change at leading edges of the sustaining pulse is sharp. In other words, since a start timing of the display discharge is dispersed in the entire screen, the concentration of the discharge current is relieved.

Also, Japanese unexamined patent publication No. 2000-206928 discloses a method for dispersing the start timing of the discharge by making the waveform of the sustaining pulse be a step-like shape having a two-step voltage change at a leading edge of the sustaining pulse. Japanese unexamined patent publication No. 6-4039 discloses a circuit structure for relieving the concentration of current by shifting application timing for each of plural blocks constituting the screen.

There are problems in the conventional driving method. One of them is that power is consumed wastefully when the number of cells to be lighted is small and thus efficiency of light emission drops. Another problem is that ion bombardment received by the fluorescent material and the dielectric layer is larger when the number of cells to be lighted is small compared to the case when the number of cells to be lighted is large. As explained above, the dispersion of the start timing of the display discharge can reduce a peak value (a maximum instantaneous value) of the discharge current. However, the peak value of the discharge current is larger when the number of cells to be lighted is large compared to the case when the number of cells to be lighted is small. In addition, the voltage drop is more conspicuous if the current flows more. Therefore, it is necessary to determine the amplitude of the sustaining pulse in designing a drive condition in expectation of a voltage drop in the case where the number of cells to be lighted is large so that display discharge can be generated even if a voltage drop occurs. In this way, if the amplitude of the sustaining pulse is determined on the basis of the case where the number of cells to be lighted is large, voltage higher than necessary is applied to cells when the number of cells to be lighted is small. As a result, excessive display discharge occurs, efficiency of light emission drops, and cells may receive excessive ion bombardment.

Related Patent Publication 1:

Japanese unexamined patent publication No. 2001-34227

Related Patent Publication 2:

Japanese unexamined patent publication No. 2000-206928

Related Patent Publication 3:

Japanese unexamined patent publication No. 6-4039

SUMMARY OF THE INVENTION

An object of the present invention is to reduce wasteful power consumption and to reduce ion bombardment that can deteriorate cells so that cells can have a long life.

According to the present invention, a ratio of lighting that is a ratio of the number of cells to be lighted to the total sum number of cells is detected in accordance with display data that determine contents of addressing. In accordance with the detected ratio of lighting, a waveform of a voltage pulse that is applied in the sustaining step for displaying the corresponding display data is changed so that a gradient of the voltage change at a leading edge becomes smaller for a large value of the ratio of lighting than for a small value of the same. By applying the voltage pulse having a gentle leading edge, a variation in discharge characteristics among cells is utilized for dispersing display discharge of plural cells in time scale. The dispersion of display discharge relieves concentration of discharge current and reduces a peak value of the discharge current. In addition, the leading edge of the voltage pulse is made gentler for a larger value of the ratio of lighting, so that the peak value of the discharge current when the ratio of lighting is large becomes substantially the same as the peak value of the discharge current when the ratio of lighting is small. This equalization of the peak value makes the change of the voltage drop small in the output of the power source due to the change of ratio of lighting. In other words, the voltage drop in the output of the power source becomes substantially constant regardless of the ratio of lighting. Therefore, excessive display discharge is not generated even if a voltage pulse having amplitude is applied to cells when the ratio of lighting is small, the amplitude being the same as when the ratio of lighting is large. The change of the pulse waveform can be a step-by-step change in which the ratio of lighting is classified into plural ranges and different settings are made for the ranges or can be a continuous change in which different settings are made for values of the ratio of lighting. Furthermore, when adopting a circuit structure in which a screen is divided into plural blocks and application of the pulse is controlled for each of the blocks, the waveform of the pulse may be changed for each of the blocks.

DESCRIPTION OF THE PREFERRED EMBODIMENTS

Hereinafter, the present invention will be explained more in detail with reference to embodiments and drawings.

Figure 1:
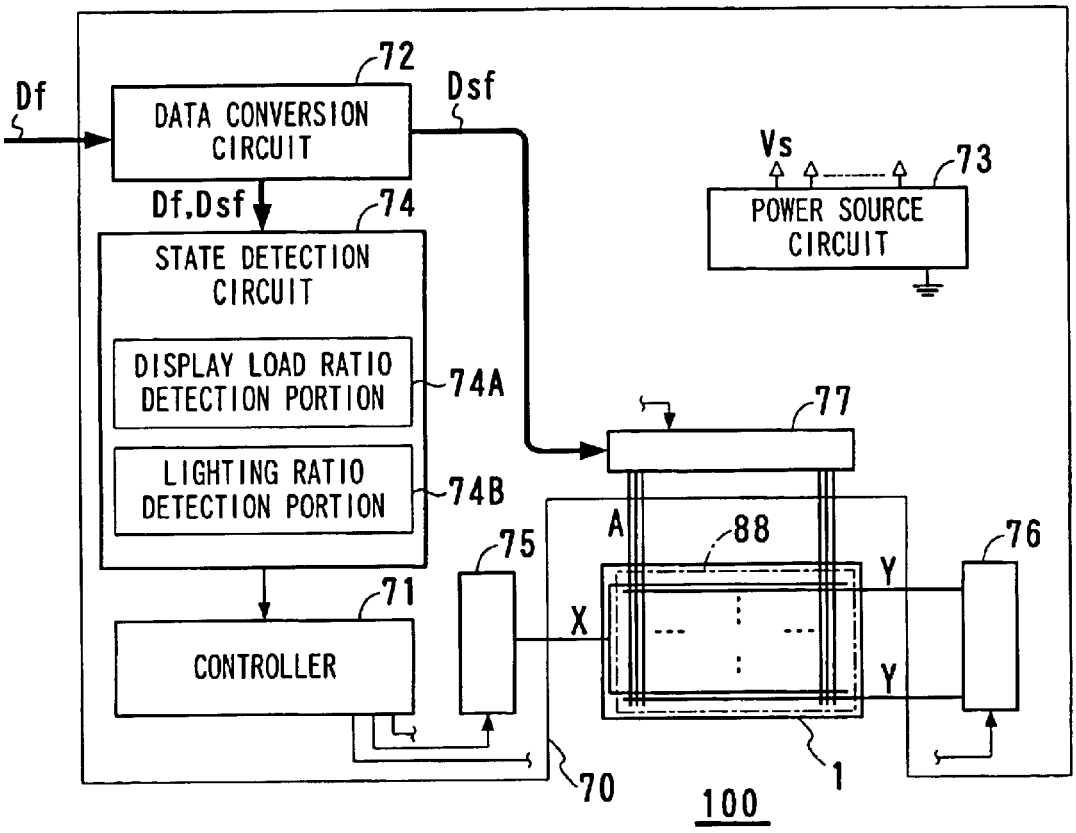
FIG. 1 is a block diagram of a display device according to the present invention.

FIG. 1 is a block diagram of a display device according to the present invention. The display device 100 includes a surface discharge AC type PDP 1 having a color screen 88 and a drive unit 70 for controlling light emission of cells. The display device 100 is used as a wall-hung television set or a monitor display of a computer system.

The PDP 1 includes electrode pairs for generating display discharge each of which includes a display electrode X and a display electrode Y arranged in parallel, and address electrodes A arranged so as to cross the display electrodes X and Y. The display electrodes X and Y extend in the row direction (in the horizontal direction) of the screen 88, while the address electrodes extend in the column direction (in the vertical direction).

The drive unit 70 includes a controller 71, a data conversion circuit 72, a power source circuit 73, a state detection circuit 74, an X-driver 75, a Y-driver 76 and an A-driver 77. The drive unit 70 is supplied with frame data Df that indicate luminance levels of red, green and blue colors from an external device such as a TV tuner or a computer together with various synchronizing signals. The frame data Df are stored in a frame memory of the data conversion circuit 72 temporarily. The data conversion circuit 72 converts the frame data Df into sub frame data Dsf for a gradation display and sends the sub frame data Dsf to the A-driver 77. The sub frame data Dsf is a set of display data in which one bit corresponds to one cell, and a value of each bit indicates whether the cell is lighted or not in the corresponding sub frame, more specifically, whether address discharge is necessary or not. The A-driver 77 applies an address pulse to an address electrode A that is connected to cells in which the address discharge is generated in accordance with the sub frame data Dsf. An application of a pulse to an electrode means to bias the electrode to a predetermined potential temporarily. The controller 71 controls applications of the pulse and transmission of the sub frame data Dsf. The power source circuit 73 supplies the drivers with electric power necessary for driving the PDP 1.

The state detection circuit 74 includes a portion 74A for detecting a "ratio of display load" in each frame and a portion 74B for detecting a "ratio of lighting" in each sub frame, the ratio of lighting being unique to the present invention. The ratio of display load is an index of power consumption and is defined as an average value of all discharge cells having the ratio Gi/Gmax when a gradation value of a cell in one frame is Gi ($0 \leqq Gi \leqq Gmax$). This ratio of display load is used for an auto power control (APC) for reducing the application of the sustaining pulse when displaying a bright image so as to suppress power consumption and heat generation. On the other hand, the ratio of lighting is a ratio of the number k of cells to be lighted in a sub frame to the total number K of all cells (e.g., as a percentage the ratio of lighting=$k/K \times 100$) and is an index of a voltage drop in the sustaining step. The state detection circuit 74 counts the number of bits indicating cells to be lighted in accordance with the sub frame data Dsf so as to detect the ratio of lighting and inform the controller 71 of the detected ratio of lighting. The ratio of lighting is used for changing and setting the waveform of the sustaining pulse.

Figure 2:
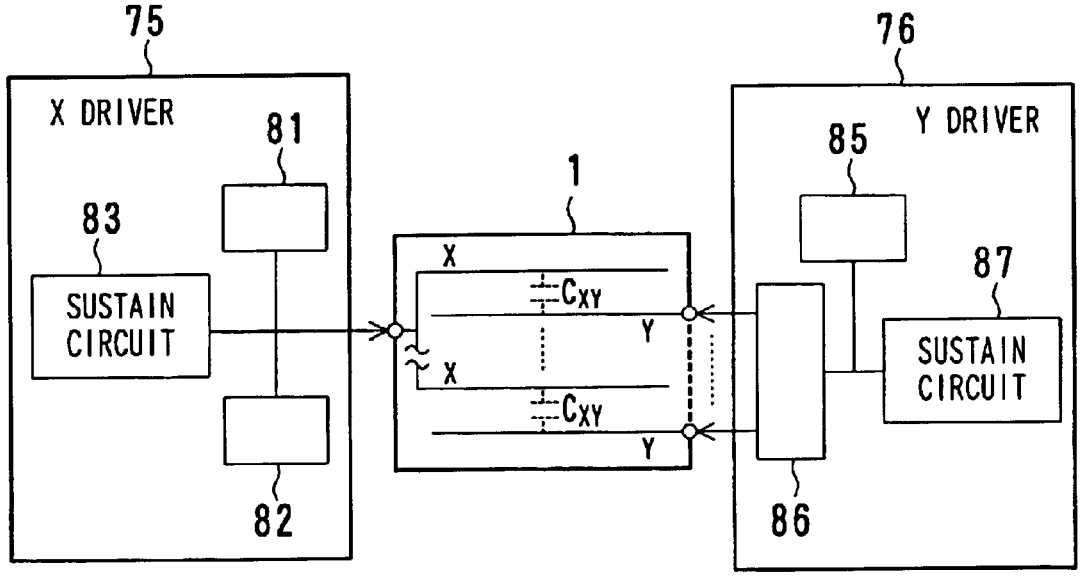
FIG. 2 is a schematic diagram of an X-driver and a Y-driver.

FIG. 2 is a schematic diagram of an X-driver and a Y-driver. The X-driver 75 includes a reset circuit 81 for applying a pulse for initializing wall charge to the display electrode X, a bias circuit 82 for controlling potential of the display electrode X in the addressing step for generating wall charge in cells to be lighted and a sustain circuit 83 for applying a sustaining pulse to the display electrode X in the sustaining step for generating display discharge in cells to be lighted, the number of times of display discharge corresponding to display data. The Y-driver 76 includes a reset circuit 85 for applying a pulse for initializing wall charge to the display electrode Y, a scan circuit 86 for applying a scan pulse to the display electrode Y in the addressing step and a sustain circuit 87 for applying a sustaining pulse to the display electrode Y in the sustaining step. The bias circuit 82 in the X-driver 75 and the scan circuit 86 in the Y-driver 76 structure means for realizing the addressing step along with the controller 71, the data conversion circuit 72 and the A-driver 77. The sustain circuit 83 in the X-driver 75 and the sustain circuit 87 in the Y-driver 76 structure means for realizing the sustaining step along with the controller 71.

Figure 3:
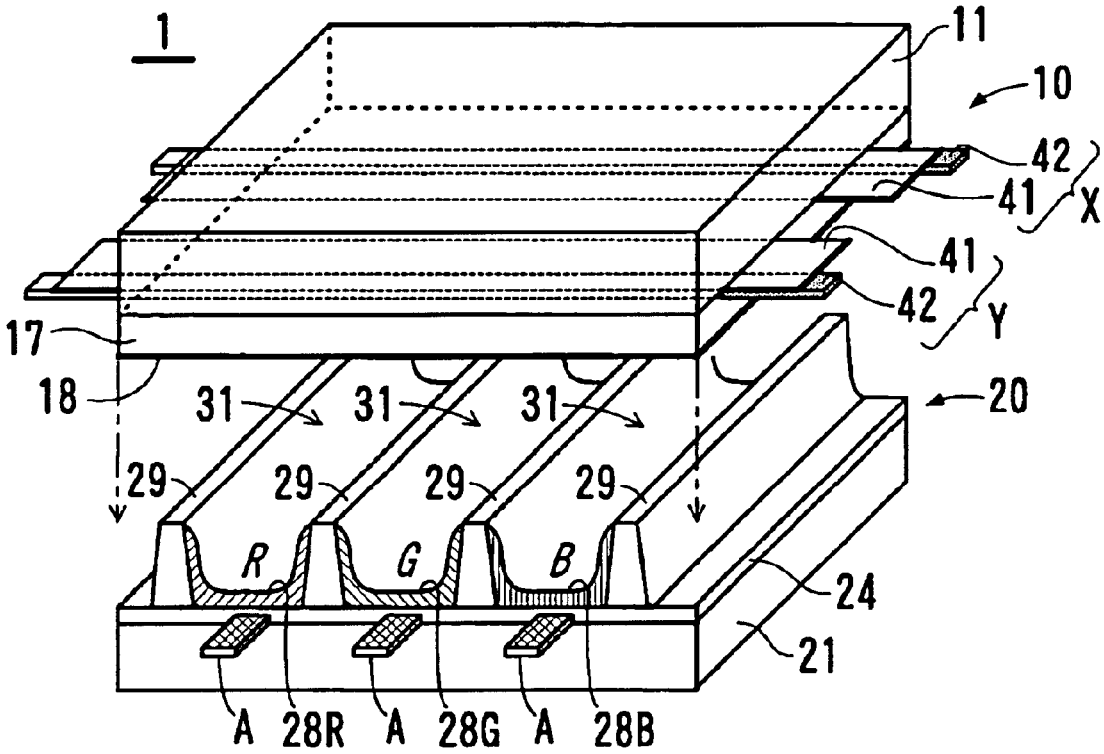
FIG. 3 is a perspective diagram showing an example of a cell structure in a PDP.

FIG. 3 is a perspective diagram showing an example of a cell structure in a PDP. In FIG. 3, a part corresponding to three cells for one pixel display of the PDP 1 is illustrated with a pair of substrate structural bodies 10 and 20 separated so that the inner structure can be seen. The PDP 1 has a pair of substrate structural bodies 10 and 20. The substrate structural body means a structural body including a glass substrate and other elements such as electrodes arranged on the glass substrate. In the PDP 1, the inner surface of the front glass substrate 11 is provided with the display electrodes X and Y, the dielectric layer 17 and the protection film 18, while the inner surface of the back glass substrate 21 is provided with the address electrodes A, the insulator layer 24, partitions 29 and fluorescent material layers 28R, 28G and 28B. Each of the display electrodes X and Y includes a transparent conductive film 41 for forming a surface discharge gap and a metal film 42 as a bus conductive member. The partitions 29 are arranged so that one partition corresponds to one electrode gap of the address electrode arrangement, and these partitions 29 divide the discharge space in the row direction into column spaces. The column space 31 corresponding to each column in the discharge space is continuous over all rows. The fluorescent material layers 28R, 28G and 28B are excited locally by ultraviolet rays emitted by the discharge gas and emit light. Italic letters R, G and B in FIG. 3 indicate light emission colors of the fluorescent materials.

Figure 4:
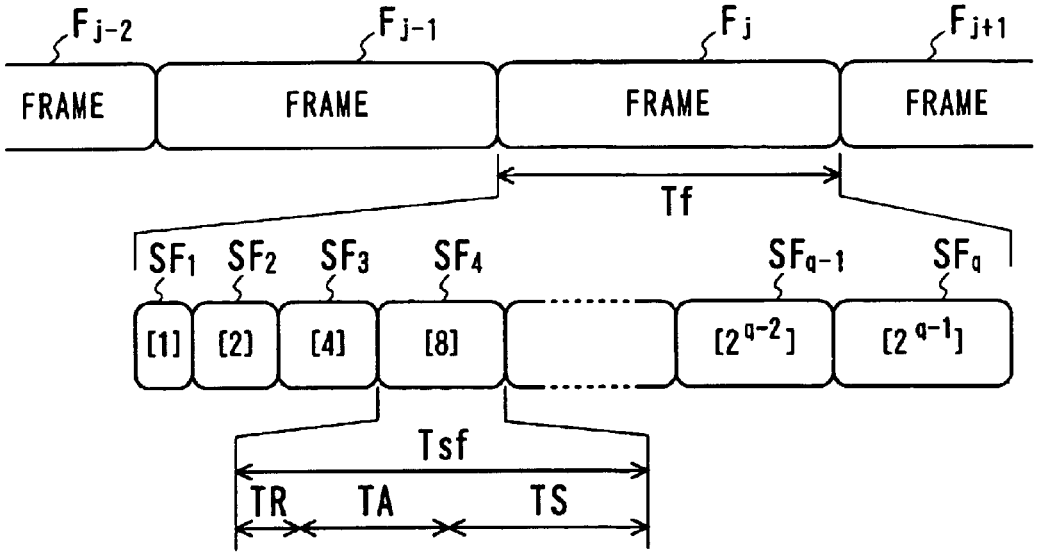
FIG. 4 is a conceptual diagram of frame division.

A general driving sequence of the PDP 1 in the above-mentioned display device 100 is as follows. In the display of the PDP 1, reproduction of colors is realized by binary control of lighting. Therefore, each of the sequential frames F constituting an input image is divided into a predetermined number q of sub frames SF as shown in FIG. 4. In other words, each of the frames F is replaced with a set of q sub frames SF. These sub frames SF are assigned weights, e.g., $2^0, 2^1, 2^2, \ldots, 2^{q-1}$ in turn, so that the number of times of display discharge is determined for each sub frame SF. Though the sub frame arrangement is in the order of weights in FIG. 7, it can be in other order. In accordance with this frame structure, the frame period Tf that is a frame transmission period is divided into q sub frame periods Tsf, and one sub frame period Tsf is assigned to each of the sub frames SF. In addition, the sub frame period Tsf is divided into a reset period TR for initializing wall charge, an address period TA for the addressing step and a display period TS for the sustaining step. The lengths of the reset period TR and the address period TA are constant regardless of the weight, while the length of the display period TS is longer for larger weight. Therefore, the length of the sub frame period Tsf is also longer as the weight of the corresponding sub frame SF is larger. In the q sub frames SF, the order of the reset period TR, the address period TA and the display period TS is common. The initialization of wall charge, the addressing step and the sustaining step are performed for each sub frame.

Figure 5:
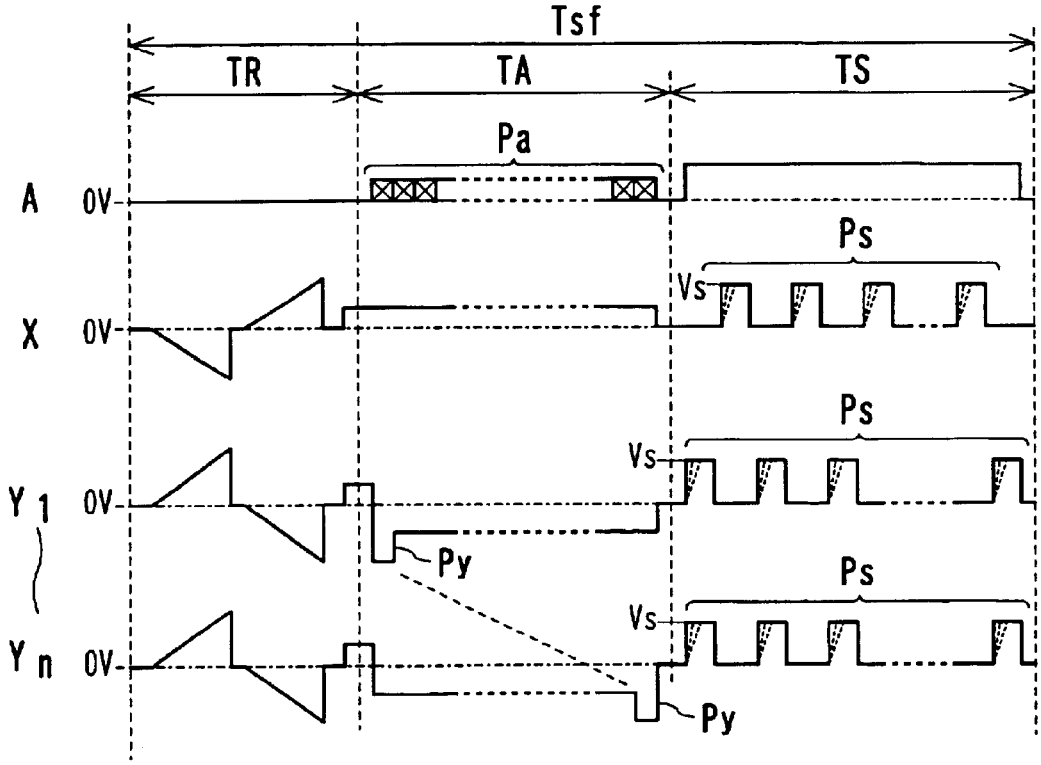
FIG. 5 is a diagrammatic chart of drive voltage waveforms.

FIG. 5 is a diagrammatic chart of drive voltage waveforms. In FIG. 5, the suffix (1, n) of the reference numeral of the display electrode Y indicates the arrangement order of the corresponding row. The illustrated waveforms are one example, and the amplitude, the polarity and the timing can be changed variously.

In the reset period TR of each sub frame, ramp waveform pulses having the negative polarity and the positive polarity are applied sequentially to all display electrodes X, and ramp waveform pulses having the positive polarity and the negative polarity are applied sequentially to all display electrodes Y so that increasing voltage is applied between the display electrodes of all cells. The amplitude of these ramp waveform pulses increase at a sufficiently small rate such that micro discharge is generated. The cells are supplied with combined voltage that is a total sum of the amplitude of pulses that are applied to the display electrodes X and Y. The micro discharge generated by the first application of the increasing voltage makes all cells generate appropriate wall voltage in the same polarity regardless of the lighted or non-lighted in the previous sub frame. The micro discharge generated by the second application of the increasing voltage adjusts the wall voltage to a value corresponding to the difference between the discharge start voltage and the amplitude of the applied voltage.

In the address period TA, wall charge that is necessary for the sustaining step is formed only in the cells to be lighted. While all display electrodes X and all display electrodes Y are biased to a predetermined potential, a scan pulse Py is applied to one display electrode Y corresponding to the selected row every row selection period (every scanning time of one row). At the same time with this row selection, an address pulse Pa is applied only to the address electrodes A corresponding to selected cells in which address discharge is generated. In other words, in accordance with the sub frame data Dsf of m columns of the selected row, potential of the address electrode A is controlled in a binary manner. In the selected cell, discharge is generated between the display electrode Y and the address electrode A, and the discharge causes surface discharge between display electrodes. This series of discharge is address discharge.

In the display period TS, a sustaining pulse Ps is applied to the display electrode Y and the display electrode X alternately. Thus, a sustaining pulse train having alternating polarities is applied between display electrodes. The application of the sustaining pulse Ps causes surface discharge in cells having predetermined quantity of remaining wall charge. The number of times of applying the sustaining pulse corresponds to the weight of the sub frame as explained above. Furthermore, as shown in the example, the address electrode A can be biased in the same polarity as the sustaining pulse Ps during the display period TS so that undesired discharge is suppressed.

Among the above-explained driving sequence, application of the sustaining pulse Ps in the display period TS has a strong connection to the present invention. It is important that the waveform of the sustaining pulse Ps is not fixed but is changed in accordance with the ratio of lighting.

Figure 6:
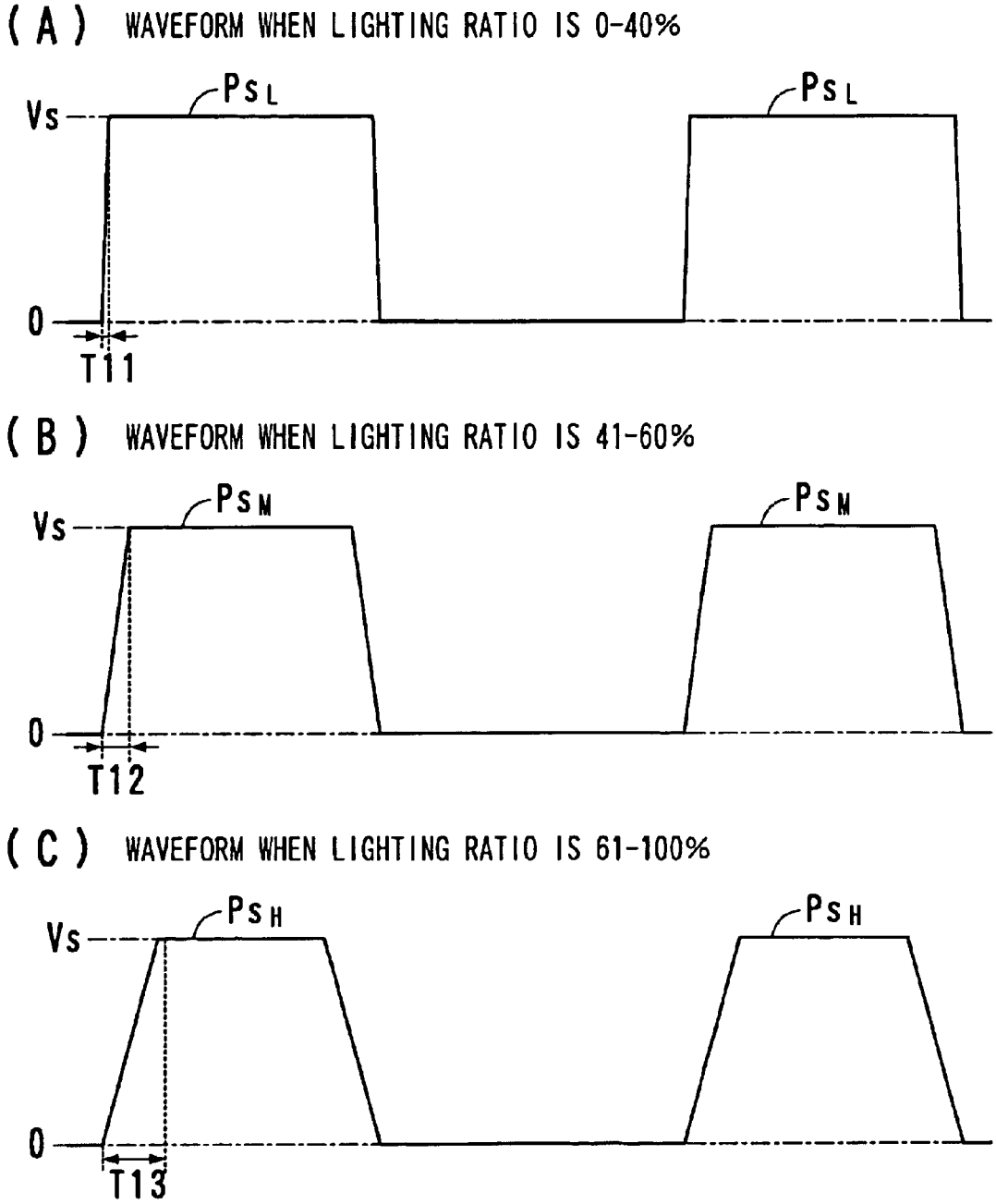
FIG. 6 is a diagrammatic chart of switching of a sustaining pulse waveform in a first example.

FIG. 6 is a diagrammatic chart of switching of a sustaining pulse waveform in a first example. In the illustrated example, the ratio of lighting is classified into three ranges, i.e., 0–40%, 41–60% and 61–100%, and waveforms of sustaining pulses $Ps_L$, $Ps_M$ and $Ps_H$ are determined for each range. Among these sustaining pulses $Ps_L$, $Ps_M$ and $Ps_H$, the gentleness of the voltage change at the leading edge, i.e., the lengths of the voltage increasing periods T11, T12 and T13 are different. The relationship among the lengths is T11<T12<T13. The amplitude (i.e., the difference between the base potential of the pulse and the bias potential) Vs is common to the sustaining pulses $Ps_L$, $Ps_M$ and $Ps_H$. The waveform of the sustaining pulse $Ps_L$ when the ratio of lighting is within the range of 0–40% has a rectangular shape and the leading edge thereof is sharp. The waveform of the sustaining pulse $Ps_M$ when the ratio of lighting is within the range of 41–60% has a trapezoid shape and the leading edge thereof is a little gentle. The waveform of the sustaining pulse $Ps_H$ when the ratio of lighting is within the range of 61–100% has a trapezoid shape and the leading edge thereof is gentle. In other words, the voltage change at the leading edge of the waveform is more gentle when the ratio of lighting is large than when it is small.

Figure 7:
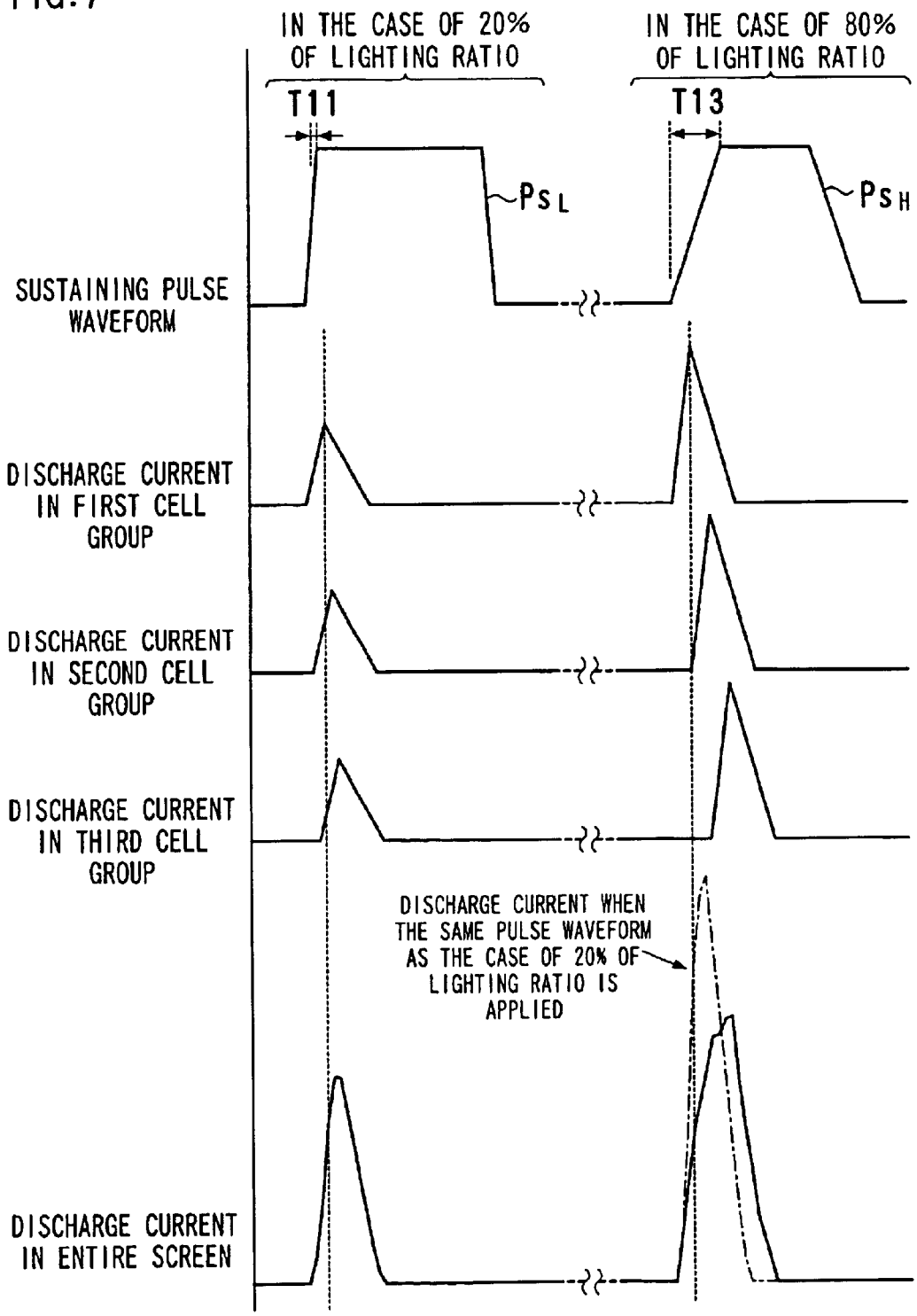
FIG. 7 is a diagrammatic chart showing effects of switching the sustaining pulse waveform in the first example.

FIG. 7 shows effects of switching the sustaining pulse waveform in the first example. Here, cells are classified into three groups for convenience. It is supposed that generation of discharge is relatively easy in cells of a first cell group, it is harder in cells of a second cell group than in cells of a first cell group, and it is harder in cells of a third cell group than in cells of a second cell group. For example, when the ratio of lighting is 20%, display discharge is generated in response to the application of the sustaining pulse PSL in cells to be lighted substantially simultaneously though there is a little difference among the first cell group, the second cell group and the third cell group. As a result, discharge current flows in a concentrated manner at one time. However, since the number of cells to be lighted is relatively small, a peak value of the discharge current is not excessive. Furthermore, when the ratio of lighting is 80%, display discharge is generated in response to the application of the sustaining pulse PSH in cells to be lighted that belong to the first cell group, the second cell group and the third cell group, in this order. Since the number of cells to be lighted is relatively large, an integral value of the discharge current is large. However, since the display discharge is dispersed in the time scale, the peak value of the discharge current is not excessive in this case, either. As shown with a dot-dashed line in FIG. 7, if the sustaining pulse $Ps_L$ is applied instead of the sustaining pulse $Ps_H$, the peak value of the discharge current will be excessive.

Next, a circuit structure for realizing switching of the waveform of the sustaining pulse will be explained in focus on the application of the sustaining pulse to the display electrode X. The application of the sustaining pulse to the display electrode Y is similar to the application of the sustaining pulse to the display electrode X, so explanation thereof is omitted.

Figure 8:
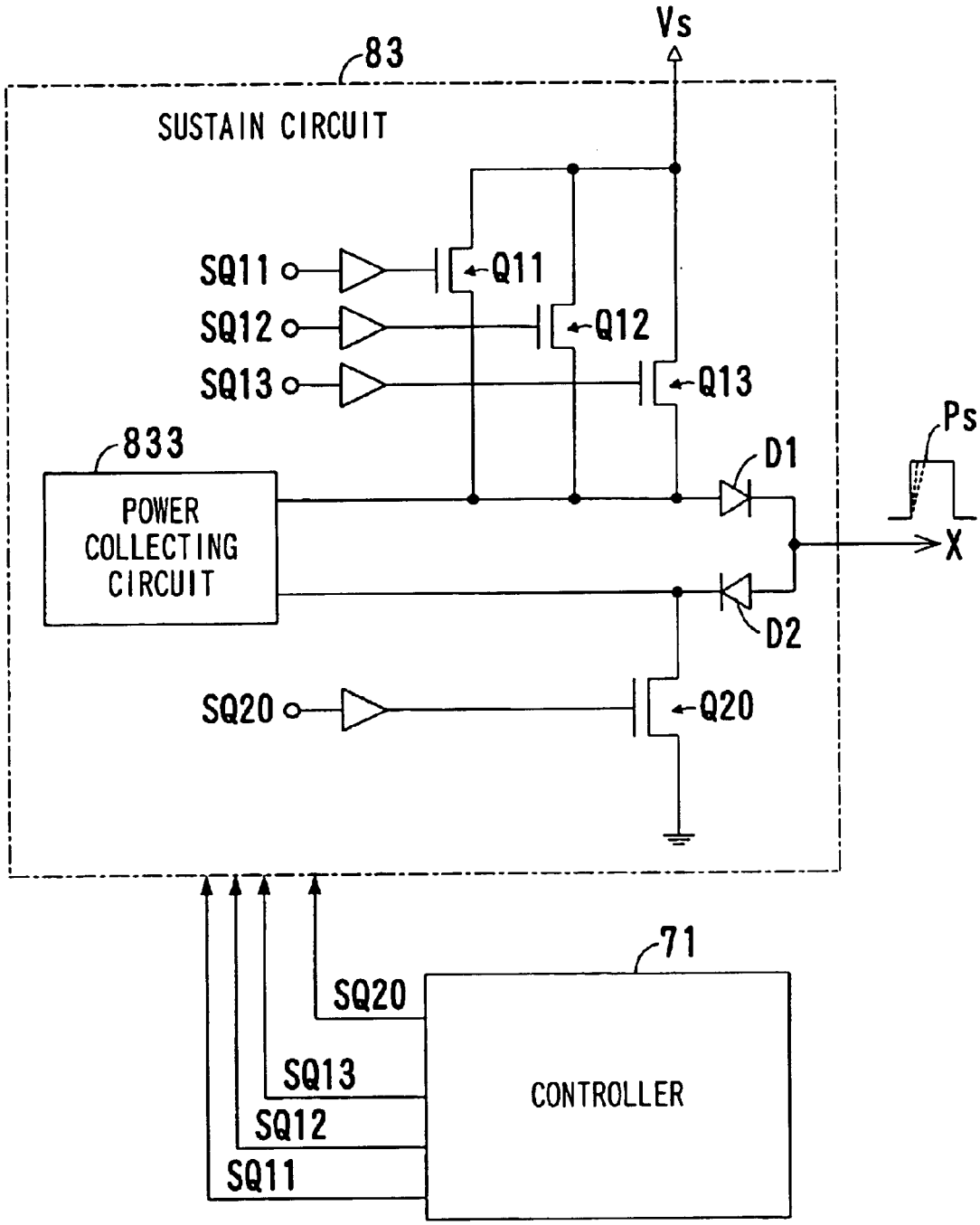
FIG. 8 is a schematic diagram of a sustain circuit.

FIG. 8 is a schematic diagram of a sustain circuit. The sustain circuit 83 is a switching circuit having a push-pull structure for outputting a pulse having an amplitude Vs. The sustain circuit 83 includes a power collecting circuit 833 for reusing charge that was used for charging a capacitance between display electrodes. When one of three field-effect transistors Q11, Q12 and Q13, all of which are connected in parallel, is turned on, the power source terminal of potential Vs is connected to the display electrode X via a backflow preventing diode D1. The field-effect transistors Q11, Q12 and Q13 are pull-up switches that bias the display electrodes X to the potential Vs. When the field-effect transistor Q20 is turned on, the ground terminal is connected to the display electrode X via a backflow preventing diode D2. The field-effect transistor Q20 is a pull-down switch that sets the potential of the display electrode X to the pulse base potential. The field-effect transistors Q11, Q12, Q13 and Q20 are operated in accordance with control signals SQ11, SQ12, SQ13 and SQ20 from the controller 71. The control signals SQ11, SQ12, SQ13 and SQ20 are transmitted to the field-effect transistors Q11, Q12, Q13 and Q20 through gate drivers.

Figure 9:
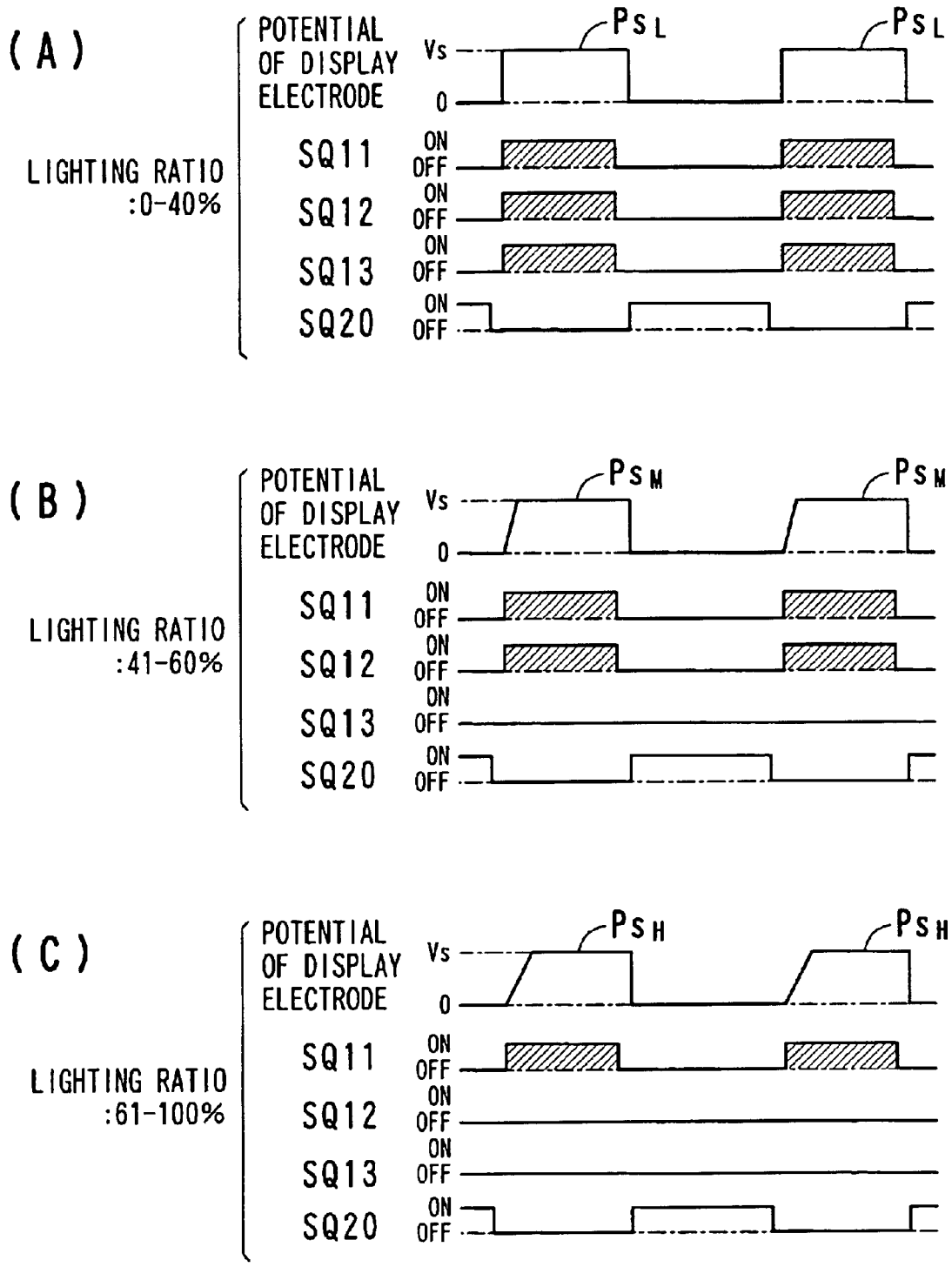
FIG. 9 is a timing chart showing a switch control of the sustaining pulse waveform.

FIG. 9 is a timing chart showing a switch control of the sustaining pulse waveform. As illustrated, when the ratio of lighting is within the range of 0–40%, three field-effect transistors Q11, Q12 and Q13 are turned on in the application of the sustaining pulse PSL. In contrast, when the ratio of lighting is within the range of 41–60%, two field-effect transistors Q11 and Q12 are turned on in the application of the sustaining pulse $Ps_M$. Further, when the ratio of lighting is within the range of 61–100%, only one field-effect transistor Q11 is turned on in the application of the sustaining pulse $Ps_H$. The smaller the number of transistors that are turned on, the larger the impedance of the current path between the power source terminal and the display electrode X, and the smaller the current that flows into the capacitance between the display electrodes. The smaller the current is, the gentler the applied voltage increases.

As another method for switching the voltage change at the leading edge of the pulse, there is a method of turning on the pull-up switch intermittently at a short period that is changed. There is still another method in which plural current paths that can be open or close and have different impedances including a capacitance or a resistance and a transistor are disposed between the pull-up switch and the display electrode X, and the plural current paths are closed selectively.

Figure 10:
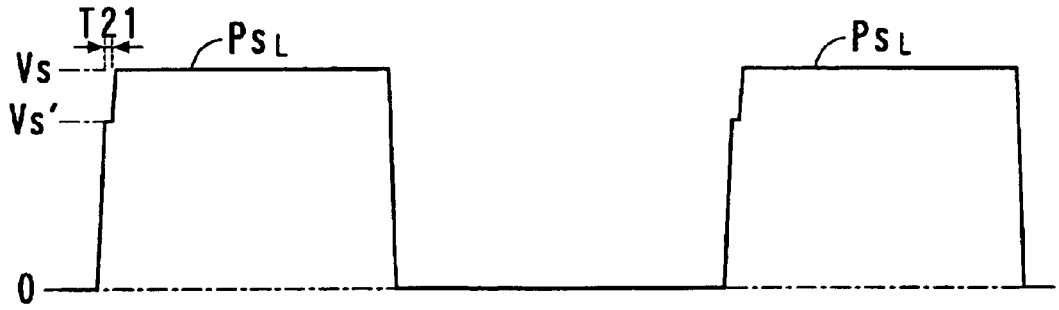
FIG. 10 is a diagrammatic chart of switching of the sustaining pulse waveform in a second example.
Figure 10:
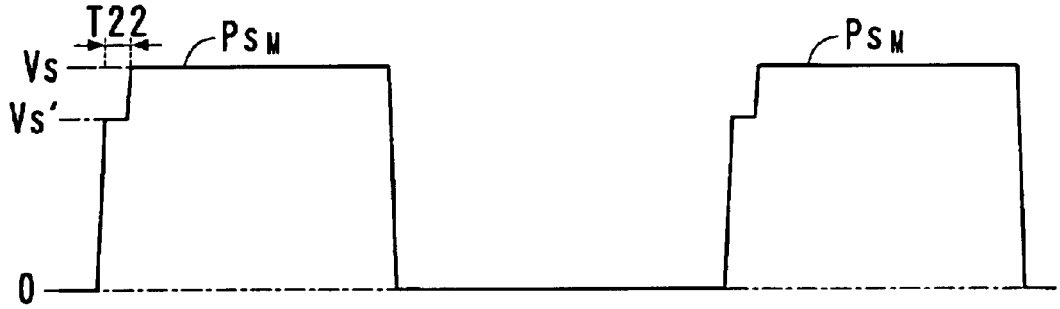
Figure 10:
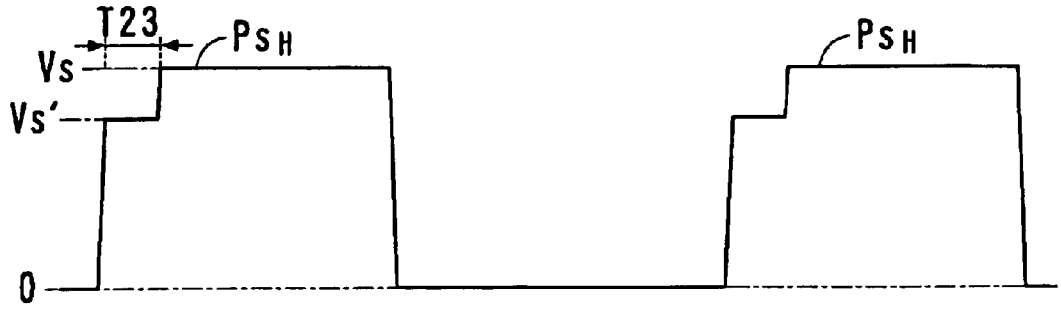

FIG. 10 is a diagrammatic chart of switching of the sustaining pulse waveform in a second example. In this second example too, the ratio of lighting is classified into three ranges of 0–40%, 41–60% and 61–100%, and waveforms of the sustaining pulses $Ps_L$, $Ps_M$ and $Ps_H$ are determined for each range. The waveforms of the sustaining pulses $Ps_L$, $Ps_M$ and $Ps_H$ have a step-like shape in which the voltage changes in a step-like manner at a leading edge. Among these sustaining pulses $Ps_L$, $Ps_M$ and $Ps_H$, lengths of mid-potential retaining periods T21, T22 and T23 for retaining a bias of potential Vs' (Vs'<Vs) at a midpoint of the voltage change in the leading edge are different from each other. The relationship among the lengths is T21<T22<T23. Since the amplitude Vs is common to the sustaining pulses $Ps_L$, $Ps_M$ and $Ps_H$, a period for changing voltage is logically longer and the voltage change at the leading edge is gentler when the mid-potential retaining periods T21, T22 and T23 are longer. Namely, the second example also utilizes a waveform having a voltage change at the leading edge that is milder when the ratio of lighting is large than when it is small, in the same way as the first example shown in FIG. 6.

Generation of the step-like waveform and switching of the lengths of the periods T21, T22 and T23 are realized by two power sources and a switching circuit that controls conduction between each of the power sources and the display electrode. First the path between the power source terminal of the potential Vs' and the display electrode is closed so as to start the application of the pulse, and the conducting state is kept until the period T21, T22 and T23 passes. Then, the path between the power source terminal of the potential Vs and the display electrode is closed. After that, the path between the ground terminal and the display electrode is closed so as to finish the application of the pulse.

Figure 11:
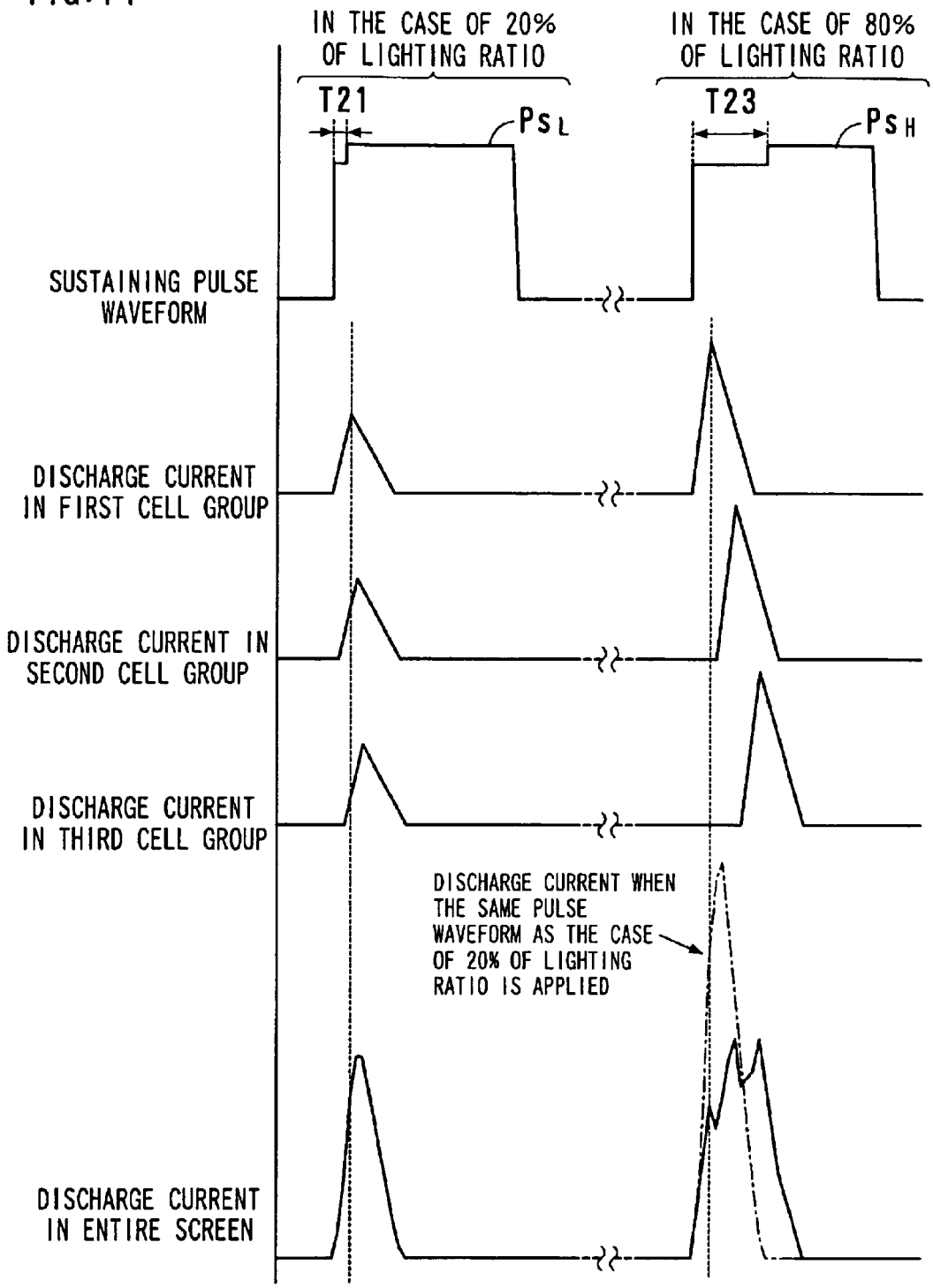
FIG. 11 is a diagrammatic chart showing effects of switching the sustaining pulse waveform in the second example.

FIG. 11 is a diagrammatic chart showing effects of switching the sustaining pulse waveform in the second example. In the second example too, the same effect is obtained as in the first example. For example, when the ratio of lighting is 20%, display discharge is generated in response to the application of the sustaining pulse $Ps_L$ in cells to be lighted substantially simultaneously though there is a little difference among the first cell group, the second cell group and the third cell group. As a result, discharge current flows in a concentrated manner at one time. However, since the number of cells to be lighted is relatively small, a peak value of the discharge current is not excessive. Furthermore, when the ratio of lighting is 80%, display discharge is generated in response to the application of the sustaining pulse $Ps_H$ in cells to be lighted that belong to the first cell group, the second cell group and the third cell group, in this order. Since the number of cells to be lighted is relatively large, an integral value of the discharge current is large. However, since the display discharge is dispersed in the time scale, the peak value of the discharge current is not excessive in this case, either. As shown with a dot-dashed line in FIG. 11, if the sustaining pulse $Ps_L$ is applied instead of the sustaining pulse $Ps_H$, the peak value of the discharge current will be excessive.

In the embodiment explained above, it is possible to include a function of detecting a drop of the sustaining voltage due to display discharge and adjusting the amplitude Vs not to be lower than a minimum permissible value. The stepwise voltage change of the step-like waveform is not limited to two steps but can be three or more steps. When the voltage change is performed in three or more steps, the length of two or more steps at a midpoint may be adjusted so as to disperse the discharge timing.

As the embodiment of the present invention, an example is explained in which the sustaining pulse Ps having a single polarity is applied to the display electrodes X and Y alternately. However, another driving form can be adopted in which pulses of the positive polarity and the negative polarity and having the amplitude of Vs/2 are applied to the display electrodes X and Y simultaneously so as to apply the sustaining voltage Vs between the display electrodes. Concerning the arrangement of the display electrodes X and Y, it is not limited to the arrangement in which a pair of them corresponds to a row of the matrix display, but can be an arrangement in which the display electrodes of the number of rows n plus one are arranged at a constant pitch so that three electrodes correspond to two rows. The present invention can be applied to any arrangement form.

Figure 12:
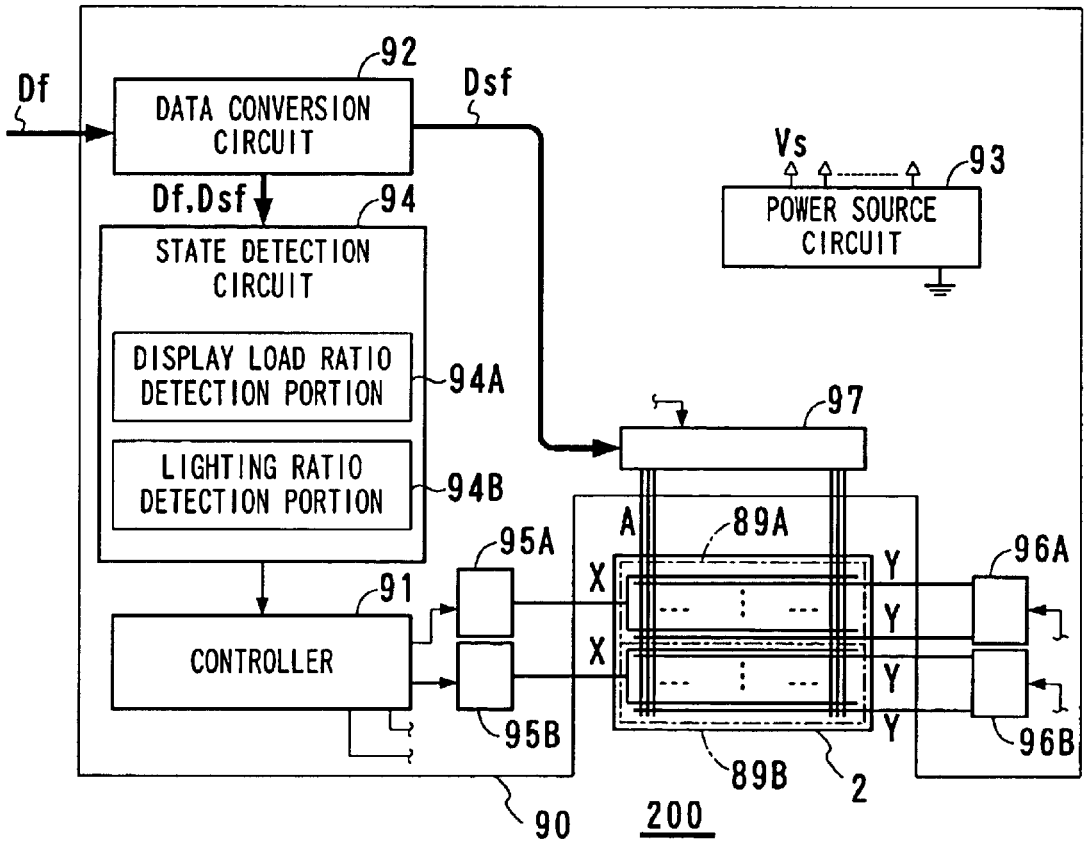
FIG. 12 is a block diagram of a display device in which drive control is performed in a screen division format.

Referring to a display device 200 in FIG. 12, if adopting a circuit structure in which a screen is divided into plural blocks 89A and 89B and pulse application is controlled for each block, a detailed driving control can be performed in which the ratio of lighting is determined for each block and the waveform of the pulse is changed in accordance with the result. If the screen is divided so that one or more rows constitute a block in accordance with the arrangement of the display electrodes X and Y and a driver is disposed for each of the blocks, the waveform of the pulse can be controlled for each block.

The display device 200 includes a surface discharge AC type PDP 2 and a drive unit 90. The structure of the PDP 2 is the same as that of the PDP 1 mentioned above with the exception that the display electrodes X are connected to each other for each block. The drive unit 90 includes a controller 91, a data conversion circuit 92, a power source circuit 93, a state detection circuit 94, X-drivers 95A and 95B, Y-drivers 96A and 96B and an A-driver 97. The state detection circuit 94 includes a portion 94A for detecting a display load ratio of each of the blocks 89A and 89B in each frame and a portion 94B for detecting a lighting ratio of each of the blocks 89A and 89B in each sub frame. The X-driver 95A and the Y-driver 96A take charge of drive of the block 89A, while the X-driver 95B and the Y-driver 96B take charge of drive of the block 89B.

According to the present invention, wasteful power consumption can be reduced when the number of cells to be lighted is small, and ion bombardment that may deteriorate cells can be suppressed so as to realize a long life of cells.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving a plasma display panel, comprising:

generating wall voltage in cells to be lighted among cells constituting a screen in accordance with display data as an addressing step;

applying a voltage pulse train to all cells at the same time after the addressing step so as to generate plural times of display discharge in the cells to be lighted in accordance with luminance of a display as a sustaining step;

detecting a ratio of lighting in accordance with display data that determine contents of addressing, the ratio of lighting being a ratio of the number of cells to be lighted to the total sum number of cells; and changing a waveform of a voltage pulse that is applied in the sustaining step for displaying the corresponding display data in accordance with the detected ratio of lighting, so that a gradient of the voltage change at a leading edge becomes smaller for a large value of the ratio of lighting than for a small value of the same.

2. A method for driving a plasma display panel, comprising:

generating wall voltage in cells to be lighted among cells constituting a screen in accordance with display data as an addressing step;

applying a voltage pulse train to all cells at the same time after the addressing step so as to generate plural times of display discharge in the cells to be lighted in accordance with luminance of a display as a sustaining step;

making a waveform of each voltage pulse of the voltage pulse train have a step-like change of voltage at a leading edge;

detecting a ratio of lighting in accordance with display data that determine contents of addressing, the ratio of lighting being a ratio of the number of cells to be lighted to the total sum number of cells; and changing a time for the voltage change at the leading edge of the voltage pulse applied in the sustaining step for displaying the corresponding display data in accordance with the detected ratio of lighting, so that the time becomes longer for a large value of the ratio of lighting than for a small value of the same.

3. A device for driving a plasma display panel, comprising:

means for generating wall voltage in cells to be lighted among cells constituting a screen in accordance with display data as an addressing step;

means for applying a voltage pulse train to all cells at the same time after the addressing step so as to generate plural times of display discharge in the cells to be lighted in accordance with luminance of a display as a sustaining step;

a lighting ratio detection circuit for detecting a ratio of lighting in accordance with display data that determine contents of addressing, the ratio of lighting being a ratio of the number of cells to be lighted to the total sum number of cells; and a controller for changing a waveform of a voltage pulse that is applied in the sustaining step for displaying the corresponding display data in accordance with the detected ratio of lighting, so that a gradient of the voltage change at a leading edge becomes smaller for a large value of the ratio of lighting than for a small value of the same.

4. A device for driving a plasma display panel, comprising:

means for generating wall voltage in cells to be lighted among cells constituting a screen in accordance with display data as an addressing step;

means for applying a voltage pulse train to all cells after the addressing step so as to generate plural times of display discharge in the cells to be lighted in accordance with luminance of a display as a sustaining step;

a lighting ratio detection circuit for detecting a ratio of lighting for each of plural blocks constituting the screen in accordance with display data that determine contents of addressing, the ratio of lighting being a ratio of the number of cells to be lighted to the total sum number of cells in each of the blocks; and a controller for changing a waveform of a voltage pulse that is applied to cells of each of the blocks in the sustaining step for displaying the corresponding display data in accordance with the detected ratio of lighting in each of the blocks, so that a gradient of the voltage change at a leading edge becomes smaller for a large value of the ratio of lighting than for a small value of the same.

* * * * *